US005193297A

United States Patent [19]

De Fex et al.

[11] Patent Number: 5,193,297

[45] Date of Patent: Mar. 16, 1993

[54] SHOPPING GUIDE

[76] Inventors: Jesus A. De Fex, 2038 Bay Ridge Ave., Brooklyn, N.Y. 11201; George Spector, 233 Broadway Rm 3815, New York, N.Y. 10007

[21] Appl. No.: 780,888

[22] Filed: Oct. 23, 1991

[51] Int. Cl.[5] ..... G09F 3/20

[52] U.S. Cl. ..... 40/5

[58] Field of Search ..... 40/5, 374, 375, 491; 116/306, 307, 321, 323, 324, 325

[56] References Cited

U.S. PATENT DOCUMENTS

| | | | |
|---|---|---|---|
| 265,693 | 10/1882 | Muckenhaupt | 40/5 |
| 1,590,793 | 6/1926 | Aitken | 116/323 |
| 1,609,216 | 11/1926 | Soth | 116/324 |
| 1,702,873 | 2/1929 | Kupfer | 116/323 |
| 1,899,382 | 2/1933 | Berry | 116/324 |
| 2,093,714 | 9/1937 | Dé Andreis . | |
| 2,507,794 | 5/1950 | Longnecker | 40/5 |
| 2,751,878 | 6/1956 | Bodor | 40/491 X |
| 2,866,433 | 12/1958 | Kallick et al. | 116/324 |
| 3,087,457 | 4/1963 | Prosen | 40/374 X |
| 3,763,820 | 10/1973 | Sage | 40/5 X |
| 4,212,261 | 7/1980 | Gaetano | 40/491 X |
| 4,475,300 | 10/1984 | Ledenican | 40/491 X |
| 4,520,749 | 6/1985 | Jefferson | 116/324 X |
| 4,637,337 | 1/1987 | Murray | 116/323 |
| 4,860,684 | 8/1989 | Al-Harbi | 116/324 X |

FOREIGN PATENT DOCUMENTS

| | | | |
|---|---|---|---|
| 0893221 | 2/1972 | Canada | 40/375 |
| 0849637 | 11/1939 | France | 116/321 |
| 0607981 | 9/1948 | United Kingdom | 40/491 |
| 1443297 | 7/1976 | United Kingdom | 40/375 |

*Primary Examiner*—Kenneth J. Dorner
*Assistant Examiner*—Milton Nelson, Jr.

[57] ABSTRACT

A shopping reminder device is provided which consists of a pair of rectangular lengthwise plates, with shorter top and bottom ends. Each plate has two columns of a plurality of spaced apart slots. A list of purchasable items is imprinted with each item adjacent each slot on each plate. Fasteners are for securing the plates together, with each plate in a raised position. A plurality of slide members are utilized with each slide member engaged within one of the slots on each plate. The slide members can be positioned to the left and right in the slots to indicate which items are to be purchased.

1 Claim, 1 Drawing Sheet

SHOPPING GUIDE

BACKGROUND OF THE INVENTION

The instant invention relates generally to shopping guides and more specifically it relates to a shopping reminder device which provides a mechanism to indicate articles to be remembered for purchase.

There are available various conventional shopping guides which do not provide the novel improvements of the invention herein disclosed.

SUMMARY OF THE INVENTION

A primary object of the present invention is to provide a shopping reminder device that will overcome the shortcomings of the prior art devices.

Another object is to provide a shopping reminder device that includes a mechanism to indicate articles to be remembered, so that when a person goes to a store to purchase the articles the device will remind the person.

An additional object is to provide a shopping reminder device in which the device can be hung on a wall or around the neck of the person, so that the articles to be remembered to be purchased can be seen therefrom.

A further object is to provide a shopping reminder device that is simple and easy to use.

A still further object is to provide a shopping reminder device that is economical in cost to manufacture.

Further objects of the invention will appear as the description proceeds.

To the accomplishment of the above and related objects, this invention may be embodied in the form illustrated in the accompanying drawings, attention being called to the fact, however, that the drawings are illustrative only, and that changes may be made in the specific construction illustrated and described within the scope of the appended claims.

BRIEF DESCRIPTION OF THE DRAWING FIGURES

DETAILED DESCRIPTION OF THE PREFERRED EMBODIMENTS

Figure 1:
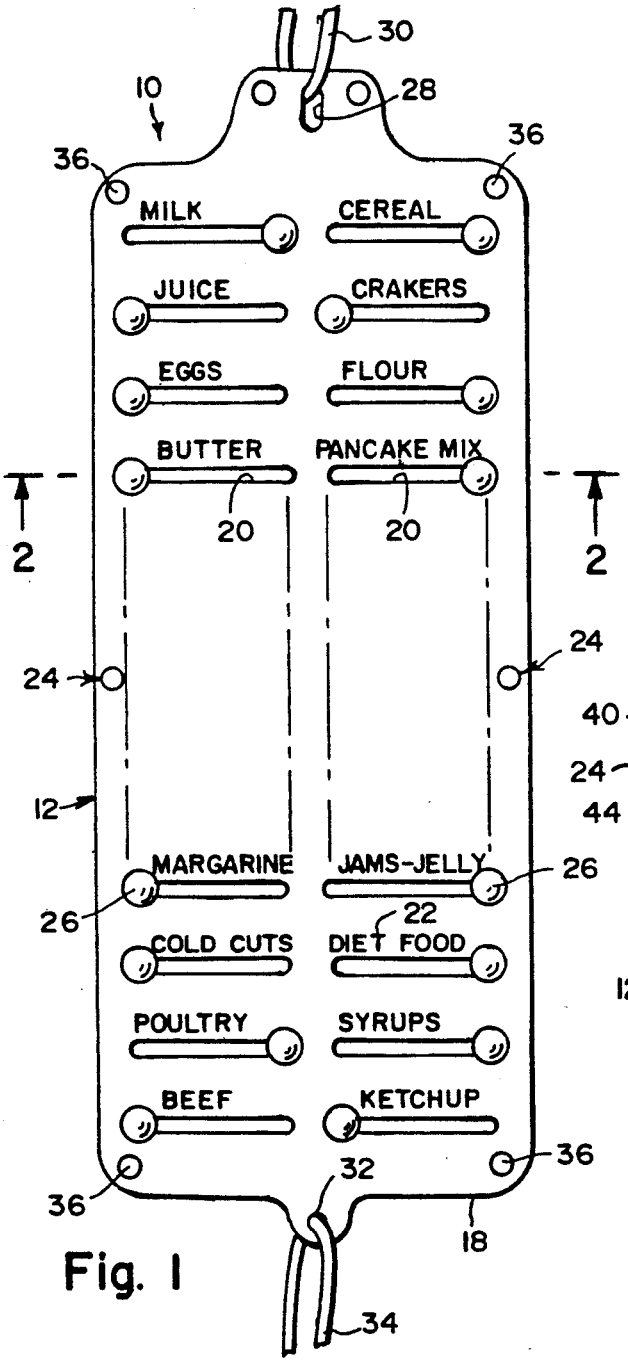
FIG. 1 is a top plan view of the instant invention.
Figure 2:
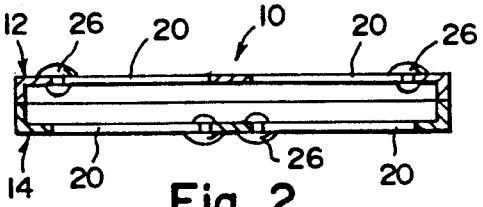
FIG. 2 is a cross sectional view taken along line 2—2 in FIG. 1.

Turning now descriptively to the drawings, in which similar reference characters denote similar elements throughout the several views, the Figures illustrate a shopping reminder device 10 which consists of a pair of rectangular lengthwise plates 12 and 14, with shorter top and bottom ends 16 and 18. Each plate 12 and 14 has two columns of a plurality of spaced apart slots 20. A list of purchasable items 22 is imprinted adjacent each slot 20 n each plate 12 and 14. A mechanism 24 is for securing the plates 12 and 14 together, with each plate 12 and 14 in a raised position. A plurality of slide members 26 are utilized with each slide member 26 engaged within one of the slots 20 on each plate 12 and 14. The slide members 26 can be positioned to the left and right in the slots 20 to indicate which items 22 are to be purchased.

The shopping reminder device 10 further includes the shorter to ends 16 of the plates 12 and having upwardly projecting aligned eyes 28, so that the shopping reminder device 10 may be hung by a cord 30 at an easily accessible location to be seen. The shorter bottom ends 18 of the plates 12 and 14 have downwardly projecting aligned eyes 32, so that the shopping reminder device 10 may be hung by a cord 34 about the neck of a person and tip upwards to be used by the person.

Figure 3:
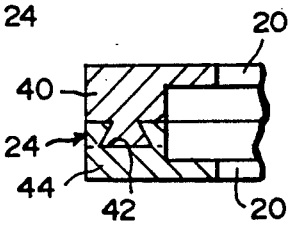
FIG. 3 is an enlarged cross sectional view of a portion of a modification showing a tongue and groove connection for the two plates.

The securing mechanism 24, as shown in FIG. 1, includes a plurality of fasteners 36, such as rivets and the like, spaced apart about and through the perimeter of the plates 12 and 14. The securing mechanism 24, as shown in FIG. 3, includes the first plate 12 having a pair of tongues, with each tongue formed on one long side 40 thereof. The second plate 14 has a pair of grooves 42, with each groove 42 formed on one long side 44 thereof, so that the tongues can mate with the grooves 42, when the plates 12 and 14 are slid onto each other.

Figure 4:
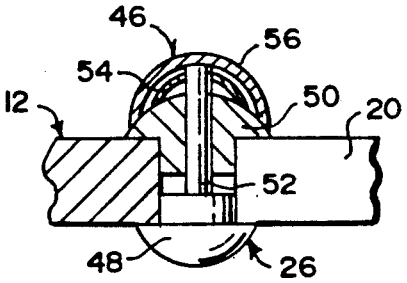
FIG. 4 is an enlarged cross sectional view through one of the slots in one of the plates with a push button release mechanism for the slide member.

Each slide member 26, as shown in FIGS. 4, can include a push button release mechanism 46, so that each slide member 26 can be positioned and retained in each respective slot 20 on each plate 12 and 14. The slide member 26 is in two pieces 48 and 50. A shaft 52 extends from one piece 48 through the other piece 50. A spring washer 54 and a curved flexible head 56 are attached to the end of the shaft 52 extending through the piece 50. When the flexible head 56 is depressed the two pieces 48 and 50 will move away from each other, so that the entire slide member 26 with the push button release mechanism 46 can be moved along the slot 20. When the flexible head 56 is released the two pieces 48 and 50 will move towards each other.

While certain novel features of this invention have been shown and described and are pointed out in the annexed claims, it will be understood that various omissions, substitutions and changes in the forms and details of the device illustrated and in its operation can be made by those skilled in the art without departing from the spirit of the invention.

What is claimed is:

1. A shopping reminder device which comprises:

a) a pair of spaced plates, each said plate having a column of spaced apart slots and transversely projecting opposing perimeter edges which engage to provide space between said plates;

b) a list of purchasable items is imprinted with each said item adjacent each said slot on each said plate;

c) means for securing said plates together along said perimeter; and d) a plurality of slide members, each mounted slidingly on said slots on each of said plates, wherein each of said slide members has an indicator external of said plates and a portion between said plates whereby said indicator can be positioned to indicate an item to be purchased; wherein each said slide member includes adjustable means for sliding and retaining said slide member in a desired position on said slot; wherein said adjustable means includes a pair of adjustable opposing buttons mounted on opposite sides of one of said plates including further means for retaining said buttons in tight frictional engagement with said plate for retaining said buttons at a desired position whereby pressure on one of said buttons releases said frictional engagement between said buttons and said plate whereby said slide member can be moved along said slot; wherein said further means comprises a shaft extending from one of said buttons through the other of said buttons including a spring biasing said shaft towards said other said button, said spring being external of said other button.

* * * * *